US008246190B2

(12) United States Patent
Boiteau et al.

(10) Patent No.: US 8,246,190 B2
(45) Date of Patent: Aug. 21, 2012

(54) BEVERAGE SERVER TRAY

(76) Inventors: Michael Boiteau, Pompano Beach, FL (US); Rocio Curran, Pompano Beach, FL (US)

( * ) Notice: Subject to any disclaimer, the term of this patent is extended or adjusted under 35 U.S.C. 154(b) by 252 days.

(21) Appl. No.: 12/724,573

(22) Filed: Mar. 16, 2010

(65) Prior Publication Data

US 2011/0226635 A1 Sep. 22, 2011

(51) Int. Cl.
*F21V 33/00* (2006.01)

(52) U.S. Cl. ..... 362/154; 362/101; 362/234; D7/552.1; 206/139; 206/201; 206/561; 220/574; 220/755; 220/756

(58) Field of Classification Search ..... 362/101, 362/154–155, 234, 253; D7/552.1, 552.2; 206/139, 201, 203, 561–563; 220/507, 574, 220/755, 756

See application file for complete search history.

(56) References Cited

U.S. PATENT DOCUMENTS 1,468,563 A * 9/1923 Girard ..... D7/552.2
D290,674 S 7/1987 Valov
4,718,555 A 1/1988 Amberg
4,803,604 A 2/1989 Nichols et al.
5,430,628 A 7/1995 Saunders
5,711,595 A * 1/1998 Gerbe ..... 362/154
5,765,689 A 6/1998 Cobden et al.
6,491,179 B2 12/2002 Dokun
D487,005 S 2/2004 Schuler
D488,965 S 4/2004 Schuler
7,017,746 B2 3/2006 Apps
7,093,715 B1 8/2006 Apps
D529,764 S 10/2006 Price
D546,627 S 7/2007 Price
7,243,786 B2 * 7/2007 Sollazzo ..... 206/201
7,281,641 B2 10/2007 Apps
D563,726 S 3/2008 Fraser
7,549,539 B2 6/2009 Apps
7,562,787 B2 7/2009 Serrano
2006/0060740 A1 3/2006 Sollazzo

* cited by examiner

*Primary Examiner* — Stephen F Husar
(74) *Attorney, Agent, or Firm* — Jacqueline Tadros, Esq.; Jacqueline Tadros, P.A.

(57) ABSTRACT

A beverage serving tray for holding, supporting, carrying and serving beverages including a receptacle plate for holding beverage containers and a bottom plate for supporting the bottom of the beverage containers, a plurality of removable vertical supports located along a perimeter for rigidly supporting and connecting the receptacle plate and the bottom plate at a distance and a cylindrical handle projecting from a side of the bottom plate for carrying the beverage tray.

19 Claims, 4 Drawing Sheets

BEVERAGE SERVER TRAY

BACKGROUND OF THE INVENTION

1. Field of the Invention

The present invention is directed to a single handle beverage serving tray for use as a table top beverage server in a resting position, or for holding with one hand and using the free hand to collect or serve a beverage to one or more persons sitting at a bar or table or to one or more persons standing in a gathering, the handle having an ergonomic shape with a gripping surface for ease of manageability.

2. Description of the Related Art

Serving drinks and beverages in a restaurant or at another location where a group is gathered, entails a server carrying and balancing a tray of beverages in one hand while using the other hand to serve the beverages. This exercise destabilizes the beverage tray and requires additional effort by the server to keep the tray and the beverages from toppling. Additionally, carrying a tray on a palm of a hand stresses the palm, hand and wrist.

Trolleys are also used for distributing beverages. However, it is problematic to maneuver a trolley in a crowded room. Also, trolleys are ineffective in situations in which stairs or uneven surfaces are encountered.

SUMMARY OF THE INVENTION

In accordance with the present invention, a beverage serving tray includes a compact body defining a beverage tray having a receptacle plate for holding beverage containers and a support plate for supporting the beverage containers. The underside of the support plate is ribbed for stronger reinforcement. The beverage tray is supported by vertical members located around the perimeter of the supporting plate. The beverage serving tray is made of a light weight plastic or other suitable material. An ergonomically designed handle is used to hold the beverage tray. The ergonomic handle is formed of a top portion and a bottom portion, the top hemispherical cylindrical portion includes an integral flange disposed at right angles which is further attached to the bottom support plate and similarly the bottom hemispherical cylinder portion includes an integral flange disposed at right angles which is further attached to a T-shaped support structure. The top hemispherical cylindrical handle portion and the bottom hemispherical cylindrical handle portion form an ergonomic cylindrical handle that is fixedly attached to the beverage tray.

It is an object of the present invention that the entire beverage serving tray can easily be assembled and dissembled for ease of transportation and shipment.

It is an object of the invention to provide a support plate with a ribbed underside, spanning longitudinally and transversally for reinforcing the bottom support plate.

It is yet another object of the invention to provide an ergonomically designed cylindrical handle with a finger gripping surface.

Accordingly, it is a principal object of the invention to provide a proportionately configured beverage tray having a receptacle for holding beverage containers, a support plate and a handle for holding, lifting and carrying the beverage tray body so as to minimize the transfer of the weight of the beverages while carrying and serving the beverages.

It is another object of the invention to provide the beverage serving tray with LED mini lights for illuminating the beverage serving tray in the dark and for decoration.

It is still an object of the invention to provide a light switch for powering the mini lights on and off.

It is still another object of the invention to embed a mini light circuit, a rechargeable battery and a socket inside a cylindrical handle.

It is still a further object of the invention to provide a duct for housing the LED circuit in the handle.

The summary of the present invention will become readily apparent upon further review of the following specifications and drawings.

BRIEF DESCRIPTIONS OF THE DRAWINGS

DETAILED DESCRIPTION OF THE PREFERRED EMBODIMENTS

Figure 1:
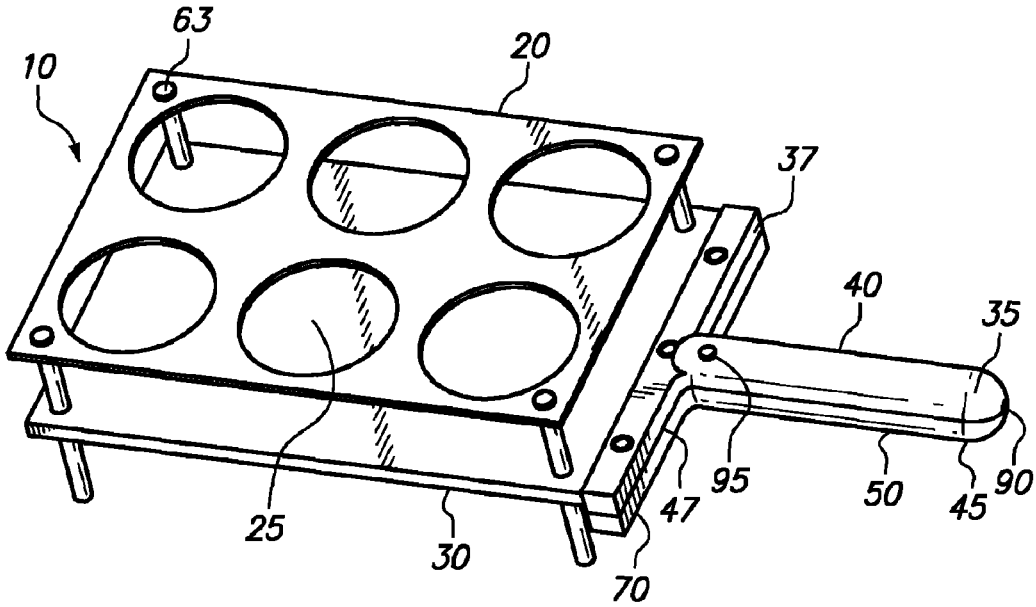
FIG. 1 Illustrates a perspective top view of a tray according to the present invention.

Referring now to FIGS. 1-6, the present invention is a beverage serving tray, designated as 10. The beverage serving tray 10 includes a receptacle plate 20 with receptacles 25 for holding beverage containers therein. The beverage serving tray 10 further includes a bottom support plate 30. Beverage containers are held within the receptacles 25 with the bottom of the beverage containers resting on the support plate 30. The receptacle plate 20 and the support plate 30 are monolithically held together by eight vertical supports 60 (61, 62) positioned along a perimeter of the support plate 30. The eight vertical supports (shown in FIG. 5) include four upper vertical supports 61 disposed between the receptacle plate 20 and the support plate 30 and the lower four vertical supports 62 disposed underneath the support plate 30. The upper vertical support 61 includes an internally threaded bore to receive a screw 63 at one end and internally threaded bore at the other end to receive the threaded nipple of the vertical support 62. A cylindrical handle 40 is formed of upper 35 and lower hemispherical cylindrical handle 45 sections which are fixedly attached. The upper hemispherical cylinder handle section 35 comprises a rectangular flange 37 fixedly disposed at right angles and further attached to the support plate 30. The support plate 30 further comprises a ribbed undersigned which includes a plurality of stiffeners 51 and 52 spanning transversally and longitudinally disposed on a bottom surface of the plate 30. The lower hemispherical cylinder handle section 45 comprises a rectangular flange 47 fixedly disposed at right angles and further fixedly attached to a T-shaped structure having a stem 41 and a flange 42 (shown in FIG. 3). The upper and the lower hemispherical cylindrical handle sections are fixedly secured to each other by screws 70 (shown in FIG. 3).

Now, particularly referring to FIG. 1, there is shown a perspective view from the top illustrating the structure of the beverage serving tray 10. The main components forming the tray 10 are indicated by reference numerals, a receptacle plate 20 having openings 25 for holding beverage containers 21 (not shown in the drawing figures) in fixed position and the bottom plate 30 which provides support to the containers 21. The plates 20 and 30 are fixedly held apart by a set of vertical supports 60 located along a perimeter of the bottom plate 30. The beverage serving tray 10 includes a cylindrical handle 40 projecting from a side of the plate 30 for carrying the beverage serving tray 10.

Figure 2:
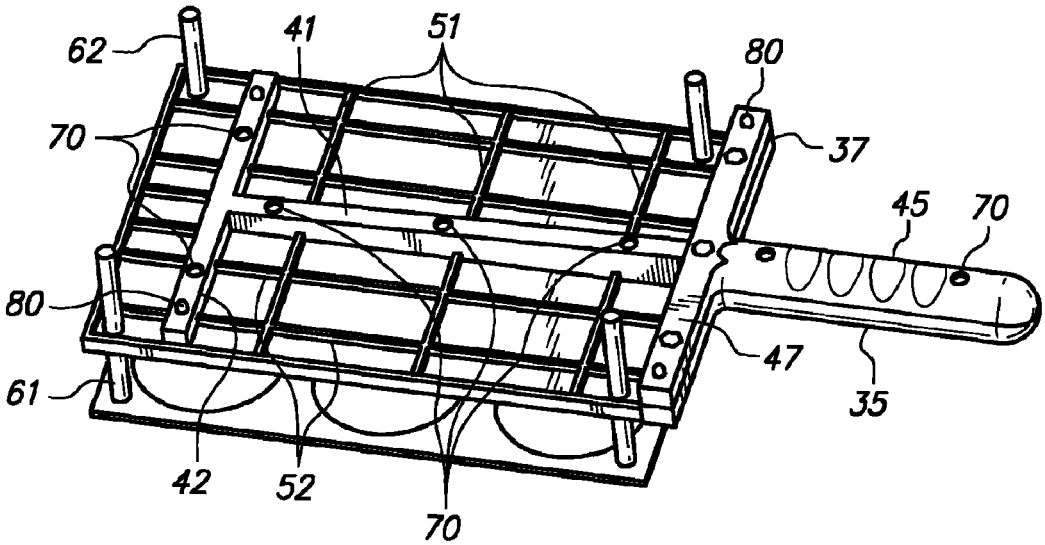
FIG. 2 Illustrates a perspective bottom view of the tray according to the present invention taken from the bottom.

Referring now to FIG. 2, there is shown a perspective view illustrating the beverage serving tray taken from the bottom. It shows the bottom most support structure of the lower hemi-spherical cylindrical handle section 45 and its attached components, a flange 37, a T-shaped structure 43 having a stem 41 and a flange 42. An underside 33 of the bottom plate 30 includes ribs 51 and 52, spanning transversally and longitudinally for additional reinforcement. Also shown are the screws 70 used for fixedly attaching the upper and lower hemispherical cylindrical handle sections 35, 45.

Figure 3:
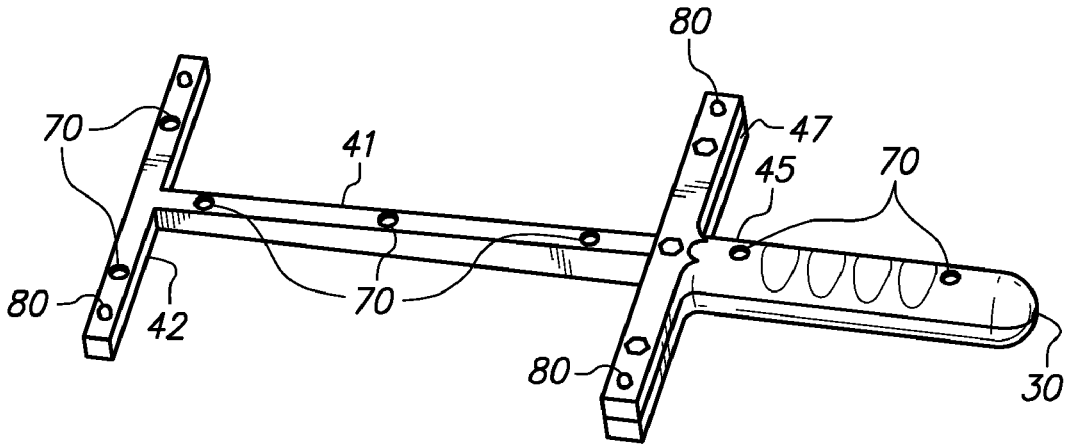
FIG. 3 Illustrates a perspective view of the bottom hemispherical cylinder handle and the supporting structure looking from bottom.

FIG. 3 is a perspective view of the lower hemispherical cylindrical handle section 45 taken from the bottom. The handle section, 45 includes a flange 47 which further comprises a T-shaped structure having stem 41, and a flange 42. There is also shown, the location of the screws 70, mini-lights 80 and a socket 90 for charging the mini-lights 80.

Figure 4:
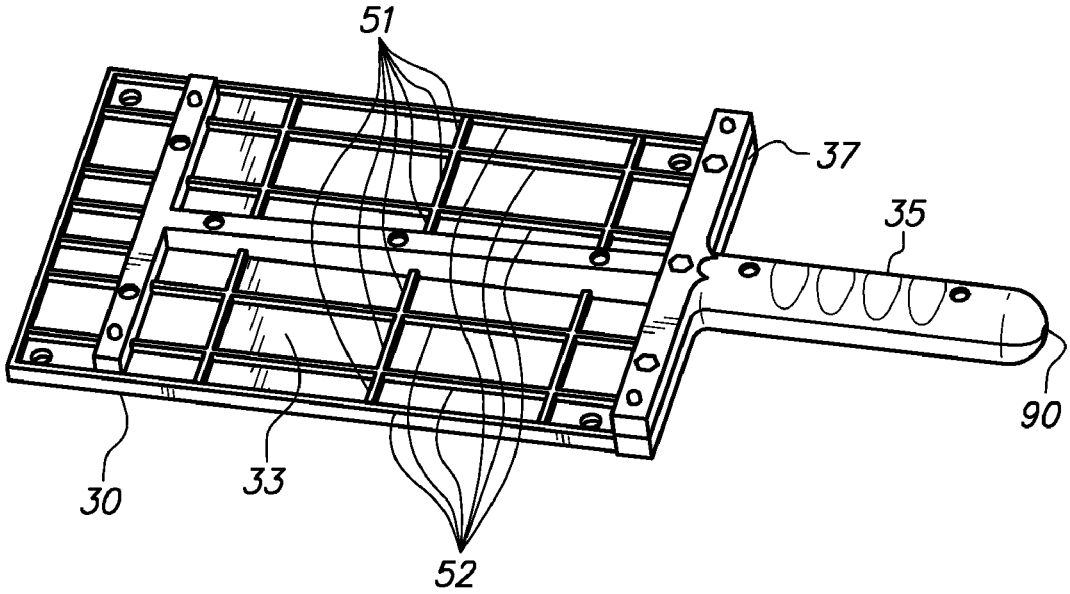
FIG. 4 Illustrates a perspective view of the top hemi-spherical cylinder handle and the bottom support plate looking from bottom.

Now, referring to FIG. 4, there is shown a perspective view of the bottom support plate 30 disposed over the T-shaped structure 43 along the bottom. It shows the upper handle section 35, a flange 37, a plurality of ribs 51 and 52 spanning across the underside 33 of the support plate 30, vertical supports 61 and 62 at each corner of the bottom plate 30 and the location of the socket 90.

Figure 5:
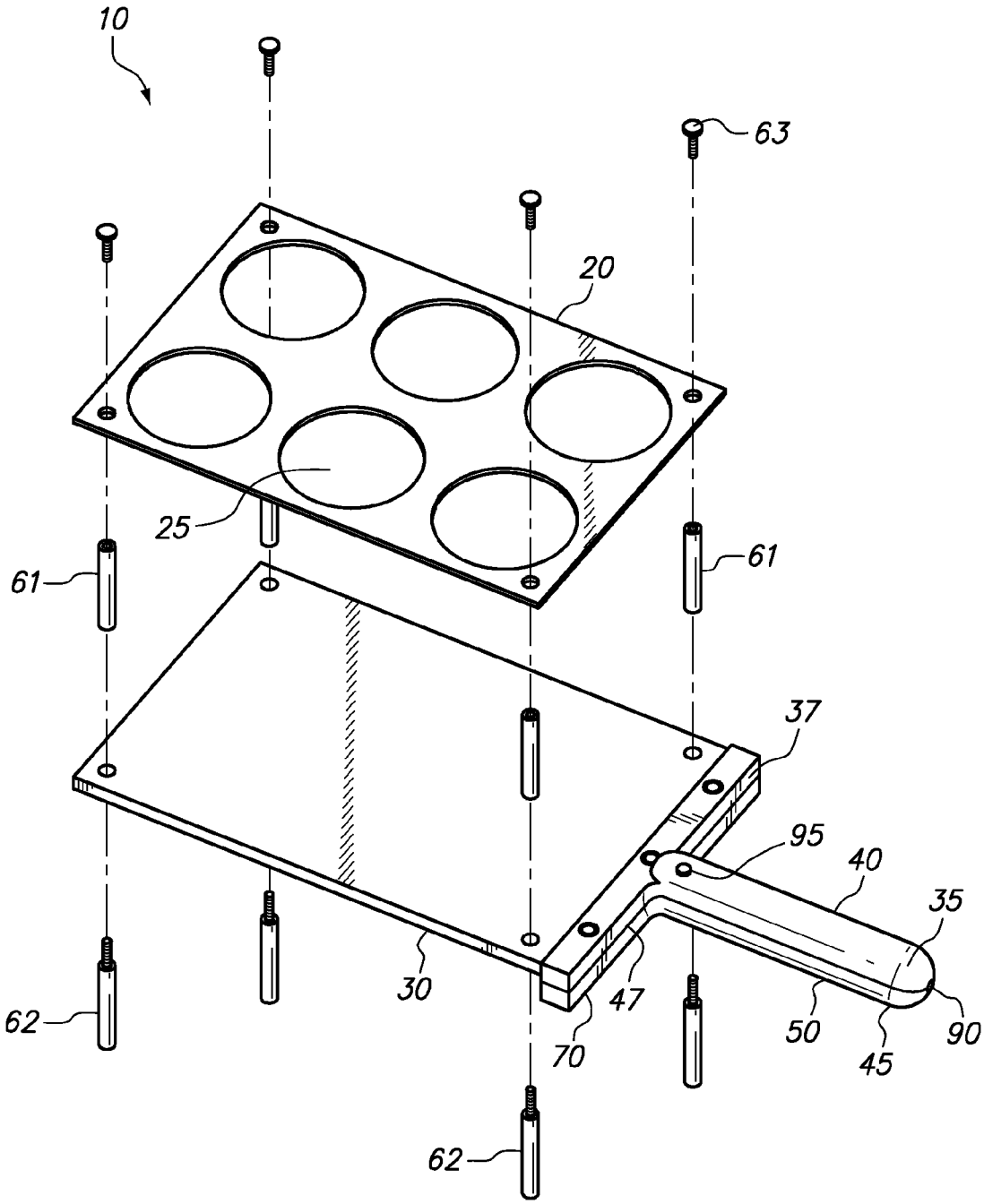
FIG. 5 Illustrates an exploded perspective view showing the dismantled tray.

Now, referring to FIG. 5, there is shown an exploded view of the serving tray 10. It shows all the components of the serving tray in a dismantled state. The serving tray structure can easily be dismantled for ease of packaging and portability and can be assembled easily.

Figure 6:
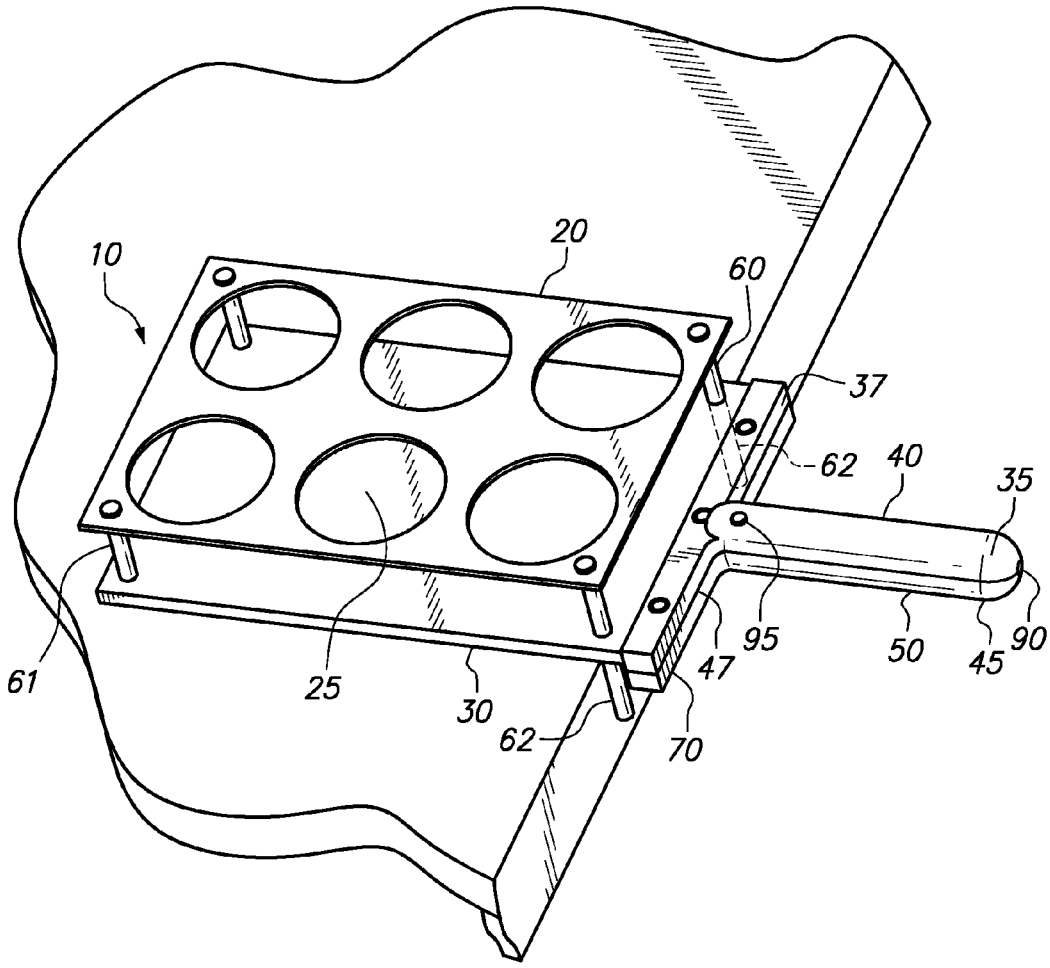
FIG. 6 Illustrates a perspective modified view of the tray according to the present invention.

Referring to FIG. 6, there is shown a perspective modified view of an alternative embodiment of the serving tray 10. The alternative embodiment of the serving tray 10 is as shown in FIG. 1 above except two lower vertical supports 62 are removed in order to place the serving tray on an edge of a surface (T), such as for example a bar counter, table top or a trolley.

We claim:

1. A beverage serving tray for holding, supporting, carrying and serving beverages, comprising:

a top plate having receptacles therein for holding beverage containers therewithin;

a bottom support plate positioned at a distance below the top plate for supporting a bottom portion of the beverage containers;

a plurality of vertical supports located along a perimeter for rigidly supporting the top receptacle plate and the bottom support plate together; and a handle projecting from the bottom support plate for carrying and serving beverages to persons in a restaurant or in a gathering.

2. The beverage serving tray according to claim 1, wherein the handle is formed of an upper and a lower cylindrical hemispherical section.

3. The handle according to claim 2, wherein the lower hemi-spherical cylindrical handle section includes a finger gripping surface.

4. The handle according to claim 2, wherein the upper hemi-spherical cylindrical handle section includes an integral flange disposed at right angles.

5. The handle according to claim 2, wherein the lower hemi-spherical cylindrical handle section includes an integral flange disposed at right angles.

6. The beverage serving tray according to claim 1, wherein the bottom support plate and the integral flange of the upper hemi-spherical cylindrical handle section form a monolithic structure.

7. The bottom support plate according to claim 6, wherein the bottom support plate includes a plurality of ribs along an underside of the support plate.

8. The bottom support plate according to claim 7, wherein the ribs span transversally and longitudinally along the underside.

9. The cylindrical handle according to claim 2, wherein the lower hemi-spherical cylindrical handle section and the integral flange are fixedly attached to a T-shaped support structure.

10. The lower hemi-spherical cylindrical handle section of claim 9, wherein the T-shaped support structure includes mini-lights.

11. The cylindrical handle according to claim 2, wherein the lower hemi-spherical cylindrical handle section including the T-shaped structure form a duct with the upper hemi-spherical cylindrical handle section including the bottom support plate for carrying an LED circuit therewithin.

12. The cylindrical handle according to claim 2, wherein the upper hemi-spherical cylindrical handle section includes a light switch for turning the mini-lights on and off.

13. The beverage serving tray according to claim 1, wherein the cylindrical handle includes an embedded rechargeable battery.

14. The beverage serving tray according to claim 1, wherein the cylindrical handle includes a socket for receiving a charge from a power outlet of a house current via a power cord.

15. The beverage serving tray according to claim 1, wherein a set of four mini-lights are positioned along the underside at each corner of the bottom support plate.

16. The cylindrical handle according to claim 2, wherein the upper and the lower hemi-spherical cylindrical handle section are fixedly secured by screws.

17. A beverage serving tray assembly for holding, supporting, carrying and serving beverages comprising:

an upper assembly comprising a top plate having receptacles adapted for holding beverages therein provided with removably attachable vertical supports for holding the upper assembly;

a lower assembly comprising a bottom plate provided with a plurality of ribs along an underside of the bottom plate and including removably attachable vertical supports for holding the lower assembly: and a support assembly comprising a cylindrical handle with an attached T-support structure adapted for supporting and carrying the upper and lower assemblies monolithically attached together for serving the beverages.

18. The beverage serving tray assembly according to claim 17, wherein the assembly can be packaged into a compact, flat shape for portability and shipping in order to minimize any damage to the serving tray structure during shipment.

19. The beverage serving tray assembly according to claim 17, wherein two of the lower vertical supports of the lower assembly located at a distal end of the cylindrical handle of the support assembly are removed and whereby an underside of the support assembly can directly be placed on an edge of a flat surface of a table top or a trolley.

* * * * *